US009528074B2

(12) United States Patent
Hogendoorn et al.

(10) Patent No.: US 9,528,074 B2
(45) **Date of Patent: *Dec. 27, 2016**

(54) LUBRICATING OIL COMPOSITIONS WITH ENHANCED PISTON CLEANLINESS

(71) Applicant: Chevron Oronite Technology B.V., Rotterdam (NL)

(72) Inventors: Richard Hogendoorn, Prinsenbeek (NL); Bertus Bernardus Hoogendam, Rotterdam (NL)

(73) Assignee: Chevron Oronite Technology B.V., Rotterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/622,106

(22) Filed: Feb. 13, 2015

(65) Prior Publication Data

US 2016/0237375 A1 Aug. 18, 2016

(51) Int. Cl.
*C10M 169/04* (2006.01)

(52) U.S. Cl.
CPC ..... *C10M 169/044* (2013.01)

(58) Field of Classification Search
CPC ..... C10M 161/00; C10M 169/044
See application file for complete search history.

(56) References Cited

U.S. PATENT DOCUMENTS

| | | | | |
|---|---|---|---|---|
| 3,172,892 | A | 3/1965 | LeSuer et al. | |
| 3,219,666 | A | 11/1965 | Norman et al. | |
| 3,272,746 | A | 9/1966 | LeSuer et al. | |
| 3,275,554 | A | 9/1966 | Wagenaar | |
| 3,329,658 | A | 7/1967 | Fields | |
| 3,361,673 | A | 1/1968 | Stuart et al. | |
| 3,368,972 | A | 2/1968 | Otto | |
| 3,405,064 | A | 10/1968 | Miller | |
| 3,438,757 | A | 4/1969 | Honnen et al. | |
| 3,449,250 | A | 6/1969 | Fields | |
| 3,454,555 | A | 7/1969 | van der Voort et al. | |
| 3,539,663 | A | 11/1970 | Pietrusza et al. | |
| 3,565,804 | A | 2/1971 | Honnen et al. | |
| 3,574,576 | A | 4/1971 | Honnen et al. | |
| 3,649,229 | A | 3/1972 | Otto | |
| 3,666,730 | A | 5/1972 | Coleman | |
| 3,909,430 | A | 9/1975 | Hotten | |
| 3,912,764 | A | 10/1975 | Palmer, Jr. | |
| 3,968,157 | A | 7/1976 | Hotten | |
| 4,152,499 | A | 5/1979 | Boerzel et al. | |
| 4,157,309 | A | 6/1979 | Wilgus et al. | |
| 4,234,435 | A | 11/1980 | Meinhardt et al. | |
| 4,605,808 | A | 8/1986 | Samson | |
| 4,655,949 | A * | 4/1987 | Landry | C07F 1/005 508/367 |
| 5,112,507 | A | 5/1992 | Harrison | |
| 5,137,978 | A | 8/1992 | DeGonia et al. | |
| 5,137,980 | A | 8/1992 | DeGonia et al. | |
| 5,175,225 | A | 12/1992 | Ruhe, Jr. | |
| 5,286,799 | A | 2/1994 | Harrison et al. | |
| 5,319,030 | A | 6/1994 | Harrison et al. | |
| 5,523,417 | A | 6/1996 | Blackborow et al. | |
| 5,565,528 | A | 10/1996 | Harrison et al. | |
| 5,616,668 | A | 4/1997 | Harrison et al. | |
| 5,625,004 | A | 4/1997 | Harrison et al. | |
| 5,777,025 | A | 7/1998 | Spencer et al. | |
| 5,792,729 | A | 8/1998 | Harrison et al. | |
| 6,165,235 | A | 12/2000 | Kolp et al. | |
| 6,372,696 | B1 | 4/2002 | Tipton | |
| 7,838,470 | B2 * | 11/2010 | Shaw | C10M 167/00 508/110 |
| 7,964,543 | B2 * | 6/2011 | Harrison | C08F 8/32 508/508 |
| 8,394,747 | B2 | 3/2013 | Harrison et al. | |
| 8,455,681 | B2 | 6/2013 | Harrison et al. | |
| 8,722,927 | B2 | 5/2014 | Harrison et al. | |
| 8,729,297 | B2 | 5/2014 | Harrison et al. | |

FOREIGN PATENT DOCUMENTS

| | | |
|---|---|---|
| EP | 542380 A1 | 5/1993 |
| EP | 355895 B1 | 12/1994 |
| EP | 602863 B1 | 5/1997 |

* cited by examiner

*Primary Examiner* — Cephia D Toomer
(74) *Attorney, Agent, or Firm* — Ryan, Mason & Lewis, LLP

(57) ABSTRACT

Disclosed herein is lubricating oil composition for providing enhanced piston cleanliness in an internal combustion engine. The lubricating oil composition include (a) from about 50 to about 65 wt. %, based on the total weight of the lubricating oil composition, of a first base oil component having a Kv at 100° C. of about 3.5 to about 4.5 cSt; (b) from about 10 to about 30 wt. %, based on the total weight of the lubricating oil composition, of a second base oil component having a Kv at 100° C. of about 5.5 to about 6.5 cSt; (c) about 1.50 wt. % to about 10 wt. %, based on the total weight of the lubricating oil composition, of at least one Mannich reaction product as disclosed herein; and (d) at least one ashless dispersant other than component (c); wherein the lubricating oil composition has a sulfur content of less than or equal to about 0.30 wt. %, a phosphorus content of less than or equal to about 0.09 wt. %, and a sulfated ash content of less than or equal to about 1.60 wt. % as determined by ASTM D 874, based on the total weight of the lubricating oil composition; and further wherein the lubricating oil composition is a SAE 0W multi-grade lubricating oil composition; with the proviso that when the lubricating oil composition has a sulfated ash content of less than or equal to 0.60 wt. %, based on the total weight the lubricating oil composition, the Mannich reaction product is present in at least about 3.0 wt. %, based on the total weight of the lubricating oil composition.

21 Claims, No Drawings

LUBRICATING OIL COMPOSITIONS WITH ENHANCED PISTON CLEANLINESS

BACKGROUND OF THE INVENTION

1. Technical Field

The present invention generally relates to low and medium sulfur, phosphorus, and sulfated ash (low and medium "SAPS") lubricating oil compositions to enhance piston cleanliness in internal combustion engines.

2. Description of the Related Art

The viscosity grade of an engine oil is a key feature when selecting a lubricating oil. The lubricating oil is typically chosen according to both the climatic temperatures to which the engine is exposed, and the temperatures and shear conditions under which the engine operates. Thus, the oil must be of sufficiently low viscosity at ambient temperatures to provide adequate lubrication upon cold starting of the engine, and capable of maintaining sufficient viscosity to lubricate the engine when it is under a full operating load.

The Society of Automotive Engineers classification system, SAE J300, defines engine oil grade viscosity specifications. Single grades are designated as SAE 20, 30, 40, 50, and 60 grade, and are defined by a low shear rate kinematic viscosity range at 100° C. (ASTM D445), as well as a minimum high shear rate viscosity at 150° C. (such as ASTM D4683, CEC L-36-A-90, or ASTM D5481). Engine oils designated as SAE 0W through 25W have been classified according to their low temperature cranking viscosities (ASTM D5293), low temperature pumping viscosities (ASTM4684), and a minimum kinematic viscosity at 100° C.

Multigrade lubricating oils perform over wide temperature ranges. Typically, they are identified by two numbers such as, for example, 5W-30 or 10W-30. The first number in the multigrade designation is associated with a safe cranking temperature (e.g., −20° C.) viscosity requirement for that multigrade oil as measured by a cold cranking simulator (CCS) under high shear rates (ASTM D5293). In general, lubricants that have low CCS viscosities allow the engine to crank more easily at lower temperatures and thus improve engine startability at those ambient temperatures.

The second number in the multigrade designation is associated with a lubricant's viscosity under normal operating temperatures and is measured in terms of the kinematic viscosity (Kv) at 100° C. (ASTM D445). The high temperature viscosity requirement brackets minimum and maximum kinematic viscosity at 100° C. Viscosity at high temperatures is desirable to prevent engine wear that would result if the lubricant thinned out too much during engine operation. However the lubricant should not be too viscous because excessive viscosity may cause unnecessary viscous drag and work to pump the lubricant which in turn can increase fuel consumption. In general, the lower a lubricants' Kv 100° C., the better the scores that lubricant achieves in fuel economy tests.

Thus, in order to qualify for a given multigrade oil designation a particular multigrade oil must simultaneously meet both strict low and high temperature viscosity requirements that are set by SAE specifications such as SAE J300.

Merely blending base stocks of different viscosity characteristics may not enable the formulator to meet the low and high temperature viscosity requirements of some multigrade oils. The formulator's primary tool for achieving this goal is an additive conventionally referred to as a viscosity modifier or viscosity index (V.I.) improver. Usually, to reach the minimum high temperature viscosity required, it is necessary to add significant amounts of viscosity modifier. However, the use of an increased amount of viscosity modifier results in increased low temperature lubricant viscosity. The ever increasing need to formulate crankcase lubricants that deliver improved performance in fuel economy tests is driving the industry to engine lubricants in the lower viscosity grades, such as SAE 0W-20, 0W-30, 5W-20 and 5W-30.

Concurrent with the demand for lower viscosity, high fuel economy lubricants, there has been a continued effort to reduce the content of sulfated ash, phosphorus and sulfur in the crankcase lubricant due to both environmental concerns and to insure compatibility with pollution control devices used in combination with modern engines (e.g., three-way catalytic converters and particulate traps). A particularly effective class of antioxidant-antiwear additives available to lubricant formulators is metal salts of dialkyldithiophosphates, particularly zinc salts thereof, commonly referred to as ZDDP. While such additives provide excellent performance, ZDDP contributes each of sulfated ash, phosphorus and sulfur to lubricants.

Catalytic converters typically contain one or more oxidation catalysts, NO storage catalysts, and/or $NH_3$ reduction catalysts. The catalysts contained therein generally comprise a combination of catalytic metals such as platinum, and metal oxides. Catalytic converters are installed in the exhaust systems, for example, the exhaust pipes of automobiles, to convert the toxic gases to nontoxic gases. The use of catalytic converters is thought to be essential in bucking global warming trends and combating other environmental detriments. The catalysts, however, can be poisoned and rendered less effective, if not useless, as a result of exposure to certain elements or compounds, especially phosphorus compounds such as ZDDP.

Particulate traps are usually installed in the exhaust system, especially in diesel engines, to prevent the carbon black particles or very fine condensate particles or agglomerates thereof (i.e., "diesel soot") from being released into the environment. Aside from polluting air, water, and other elements of the environment, diesel soot is a recognized carcinogen. These traps, however, can be blocked by metallic ash which is the degradation product of metal-containing, lubricating oil additives including common ash-producing detergent additives.

To insure a long service life for the after-treatment devices, it is desirable to identify lubricating oil additives that exert a minimum negative impact on such devices. To this end, OEMs often set various limits for maximum sulfur, phosphorus, and/or sulfated ash levels for "new service fill" and "first fill" lubricants. For example, when used in light-duty passenger-car internal combustion engines, the sulfur levels are typically required to be at or below 0.30 wt. %, the phosphorus levels at or below 0.08 wt. %, and the sulfated ash content at or below 0.8 wt. %. The maximum sulfur, phosphorus and/or sulfated ash levels may differ, however, when the lubricating compositions are used in heavy-duty internal combustion engines. For example, the maximum sulfated ash level may be as high as 1.6 wt. % in those heavy-duty engines. Such lubricating oil compositions are also referred to as "medium SAPS" (i.e., medium sulfated ash, phosphorus, and sulfur). When the maximum sulfated ash level is as high as 1.0 wt. %, the lubricating oil compositions are referred to as "low SAPS" lubricating oil compositions, e.g., for gasoline engines, and "LEDL" (i.e., low emission diesel lubricant) oil compositions for diesel engines.

Various tests have been established and standardized to measure the levels of SAPS in any particular lubricating oil compositions. For example, in Europe, a lubricant meeting the ACEA gasoline and diesel engine low SAPS specification must pass, inter alia, the "CEC L-78-T-99" test, which measures the cleanliness and extent of piston ring sticking after running a Volkswagen turbocharged direct injection automotive diesel engine for an extended time period, cycling alternatively between idle and full power. Similar specifications and testing standards of varied stringencies can also be found in other countries and regions, such as Japan, Canada, and the United States.

Meeting the low SAPS environmental standards however does not eliminate the need to provide adequate lubricant performance. Automobile spark ignition and diesel engines have valve train systems, including valves, cams, and rocker arms, all of which must be lubricated and protected from wear. Further, engine oils must provide sufficient detergency so as to insure engine cleanliness and suppress the production of deposits, which are products of non-combustibles and incomplete, combustibles of hydrocarbon fuels and deterioration of engine oils.

As discussed above, the need to preserve the integrity of catalytic converters has led to the use of less phosphate and phosphorus-containing additives. However, the use of detergents, which are typically metal sulfonate detergents, is often inevitable because of the sustained needs to neutralize the oxidation-derived acids and suspend polar oxidation residues in the lubricant. These detergents, however, contribute to the production of sulfated ash. The amount of ash permitted under most of the current environmental standards can be exceeded by far less metal sulfonate detergent than is necessary to achieve adequate detergency performance. Reducing the levels of detergent overbasing may reduce the level of ash produced, but it also reduces the acid neutralizing capacity of the lubricant composition, potentially leading to acid corrosion of the engine pistons and other parts.

Oil-soluble Mannich condensation products are useful in internal combustion engine lubricating oils. These products generally act as dispersants to disperse sludge, varnish, and lacquer, and prevent the formation of deposits. In general, conventional oil-soluble Mannich condensation products are formed from the reaction of polyisobutyl-substituted phenols with formaldehyde and an amine or a polyamine. For example, U.S. Pat. Nos. 7,964,543; 8,394,747; 8,455,681; 8,722,927 and 8,729,297 disclose that 0.01 wt. % to 10.0 wt. % of a Mannich condensation product formed by combining, under reaction conditions, a polyisobutyl-substituted hydroxyaromatic compound wherein the polyisobutyl group is derived from polyisobutene containing at least 50 weight percent methylvinylidene isomer and having a number average molecular weight in the range of about 400 to about 5000, an aldehyde, an amino acid or ester thereof, and an alkali metal base, can be used in an engine lubricating oil composition. Each of these patents further disclose in the examples that 1 wt. % of the Mannich condensation product was added to a fully formulated SAE grade 5W-30 baseline oil, SAE grade SW-40 baseline oil and a SAE grade 10W-40 baseline oil.

Thus, there is a need to provide an improved low and medium SAPS lubricating oil composition which is a SAE 0W multi-grade lubricant that can overcome poor fuel economy performance.

SUMMARY OF THE INVENTION

In accordance with one embodiment of the present invention, there is provided a lubricating oil composition comprising:

(a) from about 50 to about 65 wt. %, based on the total weight of the lubricating oil composition, of a first base oil component having a kinematic viscosity (Kv) at 100° C. of about 3.5 to about 4.5 centistokes (cSt);

(b) from about 10 to about 30 wt. %, based on the total weight of the lubricating oil composition, of a second base oil component having a Kv at 100° C. of about 5.5 to about 6.5 cSt;

(c) about 1.5 wt. % to about 10 wt. %, based on the total weight of the lubricating oil composition, of at least one Mannich reaction product prepared by the condensation of a polyisobutyl-substituted hydroxyaromatic compound, wherein the polyisobutyl group is derived from polyisobutene containing at least about 70 wt. % methylvinylidene isomer and has a number average molecular weight of from about 400 to about 2,500, an aldehyde, an amino acid or ester derivative thereof, and an alkali metal base; and (d) at least one ashless dispersant other than component (c);

wherein the lubricating oil composition has a sulfur content of less than or equal to about 0.30 wt. %, a phosphorus content of less than or equal to about 0.09 wt. %, and a sulfated ash content of less than or equal to about 1.60 wt. % as determined by ASTM D 874, based on the total weight of the lubricating oil composition; and further wherein the lubricating oil composition is a multigrade lubricating oil composition meeting the specifications for SAE J300 revised November 2007 requirements for a 0W-X multigrade engine oil, wherein X is 20, 30, 40, 50, or 60;

with the proviso that when the lubricating oil composition has a sulfated ash content of less than or equal to 0.60 wt. %, based on the total weight the lubricating oil composition, the Mannich reaction product is present in at least about 3.0 wt. %, based on the total weight of the lubricating oil composition.

In accordance with a second embodiment of the present invention, there is provided a method for improving the piston cleanliness of an internal combustion engine, the method comprising operating the internal combustion engine with a lubricating oil composition comprising:

(a) from about 50 to about 65 wt. %, based on the total weight of the lubricating oil composition, of a first base oil component having a Kv at 100° C. of about 3.5 to about 4.5 cSt;

(b) from 10 to about 30 wt. %, based on the total weight of the lubricating oil composition, of a second base oil component having a Kv at 100° C. of about 5.5 to about 6.5 cSt;

(c) about 1.5 wt. % to about 10 wt. %, based on the total weight of the lubricating oil composition, of at least one Mannich reaction product prepared by the condensation of a polyisobutyl-substituted hydroxyaromatic compound, wherein the polyisobutyl group is derived from polyisobutene containing at least about 70 wt. % methylvinylidene isomer and has a number average molecular weight in the range of from about 400 to about 2,500, an aldehyde, an amino acid or ester derivative thereof, and an alkali metal base; and (d) at least one ashless dispersant other than component (c);

wherein the lubricating oil composition has a sulfur content of less than or equal to about 0.30 wt. %, a phosphorus content of less than or equal to about 0.09 wt. %, and a sulfated ash content of less than or equal to about 1.60 wt. % as determined by ASTM D 874, based on the total weight the lubricating oil composition; and further wherein the lubricating oil composition is a multigrade lubricating oil composition meeting the specifications for SAE J300 revised November 2007 requirements for a 0W-X multi-grade engine oil, wherein X is 20, 30, 40, 50, or 60;

with the proviso that when the lubricating oil composition has a sulfated ash content of less than or equal to 0.60 wt. %, based on the total weight the lubricating oil composition, the Mannich reaction product is present in at least about 3.0 wt. %, based on the total weight of the lubricating oil composition.

In accordance with a third embodiment of the present invention, there is provided a use of a lubricating oil composition comprising:

(a) from about 50 to about 65 wt. %, based on the total weight of the lubricating oil composition, of a first base oil component having a Kv at 100° C. of about 3.5 to about 4.5 cSt;

(b) from about 10 to about 30 wt. %, based on the total weight of the lubricating oil composition, of a second base oil component having a Kv at 100° C. of about 5.5 to about 6.5 cSt;

(c) about 1.5 wt. % to about 10 wt. %, based on the total weight of the lubricating oil composition, of at least one Mannich reaction product prepared by the condensation of a polyisobutyl-substituted hydroxyaromatic compound, wherein the polyisobutyl group is derived from polyisobutene containing at least about 70 wt. % methylvinylidene isomer and has a number average molecular weight in the range of from about 400 to about 2,500, an aldehyde, an amino acid or ester derivative thereof, and an alkali metal base; and (d) at least one ashless dispersant other than component (c);

wherein the lubricating oil composition has a sulfur content of less than or equal to about 0.30 wt. %, a phosphorus content of less than or equal to about 0.09 wt. %, and a sulfated ash content of less than or equal to about 1.60 wt. % as determined by ASTM D 874, based on the total weight of the lubricating oil composition; and further wherein the lubricating oil composition is a multigrade lubricating oil composition meeting the specifications for SAE J300 revised November 2007 requirements for a 0W-X multigrade engine oil, wherein X is 20, 30, 40, 50, or 60, for improving the piston cleanliness of an internal combustion engine;

with the proviso that when the lubricating oil composition has a sulfated ash content of less than or equal to 0.60 wt. %, based on the total weight the lubricating oil composition, the Mannich reaction product is present in at least about 3.0 wt. %, based on the total weight of the lubricating oil composition.

Among other factors, the present invention is based on the surprising discovery that the present combination of dispersants can provide enhanced piston cleanliness performance required in modern low and medium SAPS lubricants which are SAE 0W multi-grade lubricants for internal combustion engines. By using the present combination of the dispersants, low and medium SAPS lubricants which are SAE 0W multi-grade lubricants can be prepared which pass a piston cleanliness and ring sticking test thereby resulting in improved fuel economy performance. In addition, it is believed that the present combination of dispersants can further provide seal compatibility in the modern low and medium SAPS lubricants which are SAE 0W multi-grade lubricants for internal combustion engines

DETAILED DESCRIPTION OF THE PREFERRED EMBODIMENTS

Prior to discussing the invention in further detail, the following terms will be defined:

Definitions

As used herein, the following terms have the following meanings, unless expressly stated to the contrary:

The term "Total Base Number" or "TBN" as used herein refers to the amount of base equivalent to milligrams of KOH in 1 gram of sample. Thus, higher TBN numbers reflect more alkaline products, and therefore a greater alkalinity reserve. The TBN of a sample can be determined by ASTM Test No. D2896-11 issued May 15, 2011 or any other equivalent procedure.

The term "metal" means alkali metals, alkaline earth metals, or mixtures thereof.

The term "alkaline earth metal" refers to calcium, barium, magnesium, and strontium.

The term "alkali metal" refers to lithium, sodium, potassium, rubidium, and cesium.

The term "sulfated ash content" refers to the amount of metal-containing additives (e.g., calcium, magnesium, molybdenum, zinc, etc.) in a lubricating oil composition and is typically measured according to ASTM D874, which is incorporated herein by reference.

The term "Mannich condensation product" as used herein refers to a mixture of products obtained by the condensation reaction of a polyisobutyl-substituted hydroxyaromatic compound with an aldehyde and an amino acid as described herein, to form condensation products having the formulas given below. The formulas given below are provided only as some examples of the Mannich condensation products believed to be of the present invention and are not intended to exclude other possible Mannich condensation products that may be formed using the methods described herein.

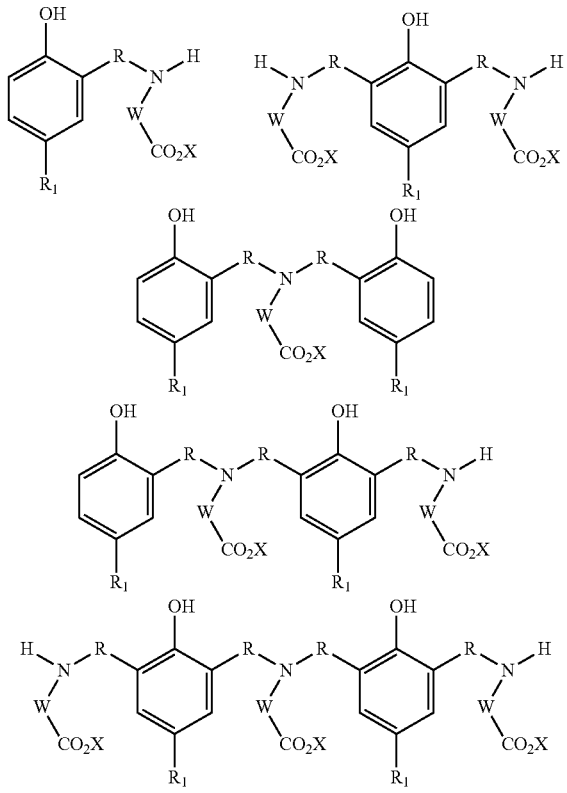

-continued

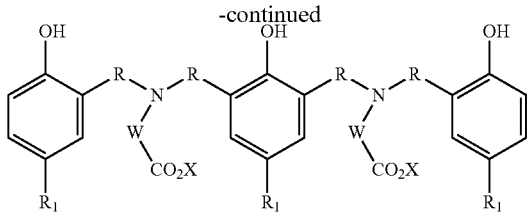

wherein R, $R_1$, X and W are as defined herein.

The present invention is directed to a lubricating oil composition comprising:

(a) from about 50 to about 65 wt. %, based on the total weight of the lubricating oil composition, of a first base oil component having a Kv at 100° C. of about 3.5 to about 4.5 cSt;

(b) from about 10 to about 30 wt. %, based on the total weight of the lubricating oil composition, of a second base oil component having a Kv at 100° C. of about 5.5 to about 6.5 cSt;

(c) about 1.5 wt. % to about 10 wt. %, based on the total weight of the lubricating oil composition, of at least one Mannich reaction product prepared by the condensation of a polyisobutyl-substituted hydroxyaromatic compound, wherein the polyisobutyl group is derived from polyisobutene containing at least about 70 wt. % methylvinylidene isomer and has a number average molecular weight in the range of from about 400 to about 2,500, an aldehyde, an amino acid or ester derivative thereof, and an alkali metal base; and (d) at least one ashless dispersant other than component (c);

wherein the lubricating oil composition has a sulfur content of less than or equal to about 0.30 wt. %, a phosphorus content of less than or equal to about 0.09 wt. %, and a sulfated ash content of less than or equal to about 1.60 wt. %, based on the total weight of the lubricating oil composition; and further wherein the lubricating oil composition is a multigrade lubricating oil composition meeting the specifications for SAE J300 revised November 2007 requirements for a 0W-X multigrade engine oil, wherein X is 20, 30, 40, 50, or 60;

with the proviso that when the lubricating oil composition has a sulfated ash content of less than or equal to 0.60 wt. %, based on the total weight the lubricating oil composition, the Mannich reaction product is present in at least about 3.0 wt. %, based on the total weight of the lubricating oil composition.

The lubricating oil compositions of the present invention are more desirable from an environmental standpoint than the conventional internal combustion engine lubricating oils that contain higher phosphorous, sulfur and sulfated ash contents. The lubricating oil compositions of the present invention also facilitate longer service lives for the catalytic converters and the particulate traps, while providing the desired piston cleanliness.

In general, the level of sulfur in the lubricating oil compositions of the present invention is less than or equal to about 0.30 wt. %, based on the total weight of the lubricating oil composition, e.g., a level of sulfur of about 0.01 wt. % to about 0.30 wt. %. In one embodiment, the level of sulfur in the lubricating oil compositions of the present invention is less than or equal to about 0.20 wt. %, based on the total weight of the lubricating oil composition, e.g., a level of sulfur of about 0.01 wt. % to about 0.20 wt. %. In one embodiment, the level of sulfur in the lubricating oil compositions of the present invention is less than or equal to about 0.10 wt. %, based on the total weight of the lubricating oil composition, e.g., a level of sulfur of about 0.01 wt. % to about 0.10 wt. %.

In one embodiment, the levels of phosphorus in the lubricating oil compositions of the present invention is less than or equal to about 0.09 wt. %, based on the total weight of the lubricating oil composition, e.g., a level of phosphorus of about 0.01 wt. % to about 0.09 wt. %. In one embodiment, the levels of phosphorus in the lubricating oil compositions of the present invention is less than or equal to about 0.08 wt. %, based on the total weight of the lubricating oil composition, e.g., a level of phosphorus of about 0.01 wt. % to about 0.08 wt. %. In one embodiment, the levels of phosphorus in the lubricating oil compositions of the present invention is less than or equal to about 0.07 wt. %, based on the total weight of the lubricating oil composition, e.g., a level of phosphorus of about 0.01 wt. % to about 0.07 wt. %. In one embodiment, the levels of phosphorus in the lubricating oil compositions of the present invention is less than or equal to about 0.05 wt. %, based on the total weight of the lubricating oil composition, e.g., a level of phosphorus of about 0.01 wt. % to about 0.05 wt. %.

In one embodiment, the level of sulfated ash produced by the lubricating oil compositions of the present invention is less than or equal to about 1.60 wt. % as determined by ASTM D 874, e.g., a level of sulfated ash of from about 0.10 to about 1.60 wt. % as determined by ASTM D 874. In one embodiment, the level of sulfated ash produced by the lubricating oil compositions of the present invention is less than or equal to about 1.00 wt. % as determined by ASTM D 874, e.g., a level of sulfated ash of from about 0.10 to about 1.00 wt. % as determined by ASTM D 874. In one embodiment, the level of sulfated ash produced by the lubricating oil compositions of the present invention is less than or equal to about 0.80 wt. % as determined by ASTM D 874, e.g., a level of sulfated ash of from about 0.10 to about 0.80 wt. % as determined by ASTM D 874. In one embodiment, the level of sulfated ash produced by the lubricating oil compositions of the present invention is less than or equal to about 0.60 wt. % as determined by ASTM D 874, e.g., a level of sulfated ash of from about 0.10 to about 0.60 wt. % as determined by ASTM D 874.

The lubricating oil composition of the present invention is a fully formulated, low or medium SAPS multigrade lubricating oil composition meeting the specifications for SAE J300 revised November 2007 requirements for 0W-X multigrade engine oils, wherein X is 20, 30, 40, 50, or 60. In one embodiment, the lubricating oil composition of the present invention is a fully formulated, low or medium SAPS SAE 0W-20 multigrade lubricating oil composition. In one embodiment, the lubricating oil composition of the present invention is a hilly formulated, low or medium SAPS SAE 0W-30 multigrade lubricating oil composition. In one embodiment, the lubricating oil composition of the present invention is a fully formulated, low or medium SAPS SAE 0W-40 multigrade lubricating oil composition. In one embodiment, the lubricating oil composition of the present invention is a fully formulated, low or medium SAPS SAE 0W-50 multigrade lubricating oil composition. In one embodiment, the lubricating oil composition of the present invention is a fully formulated, low or medium SAPS SAE 0W-60 multigrade lubricating oil composition.

Base Oil Components

The lubricating oil composition of the present invention contains from about 50 to about 65 wt. %, based on the total weight of the lubricating oil composition, of a first base oil component having a Kv at 100° C. of about 3.5 to about 4.5 cSt. In practice, this means that the first base oil component is selected from one or more natural oils, synthetic oils or mixtures thereof which meet the foregoing Kv requirements at 100° C. In one embodiment, the lubricating oil composition of the present invention from about 50 to about 60 wt. %, based on the total weight of the lubricating oil composition, of a first base oil component having a Kv at 100° C. of about 3.5 to about 4.5 cSt.

In general, the first base oil component having a Kv at 100° C. of about 3.5 to about 4.5 cSt includes at least one mineral oil basestock. In general, the at least one mineral oil basestock used in the base oil composition is selected from any of the natural mineral oils of API Groups I, II, III, IV, V or mixtures of these used in crankcase lubricating oils for spark-ignited and compression-ignited engines. API guidelines define a base stock as a lubricant component that may be manufactured using a variety of different processes.

Group I base oils generally refer to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

Group II base oils generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270).

Group III base oils generally refer to a petroleum derived lubricating base oil having less than 300 ppm sulfur, a saturates content greater than 90 weight percent, and a VI of 120 or greater. In one embodiment, the Group III base stock contains at least about 95% by weight saturated hydrocarbons. In another embodiment, the Group III base stock contains at least about 99% by weight saturated hydrocarbons. The term "major amount" as used herein is an amount of greater than 50 wt. %, or greater than about 70 wt. %, or from about 80 to about 95 wt. % or from about 85 to about 95 wt. %, based on the total weight of the composition.

Group IV base oils are polyalphaolefins (PAOs).

Group V base oils include all other base oils not included in Group I, II, III, or IV.

In one preferred embodiment, the first base oil component having a Kv at 100° C. of about 3.5 to about 4.5 cSt is a Group II or III basestock. In another preferred embodiment, the base oil component having a Kv at 100° C. of about 3.5 to about 4.5 cSt is a Group III basestock.

The lubricating oil composition of the present invention will further contain from about 10 to about 30 wt. %, based on the total weight of the lubricating oil composition, of a second base oil component having a Kv at 100° C. of about 5.5 to about 6.5 cSt. In one embodiment, the lubricating oil composition of the present invention will contain from about 15 to about 25 wt. %, based on the total weight of the lubricating oil composition, of a second base oil component having a Kv at 100° C. of about 5.5 to about 6.5 cSt. Again, in practice, this means that the second base oil component is selected from one or more natural oils, synthetic oils or mixtures thereof which meet the foregoing Kv requirements at 100° C.

In one embodiment, the second base oil component is any Group IV PAO base oil that meets the foregoing Kv requirements at 100° C. In general, the polyalphaolefin used as the second base oil component may be selected from any of the olefin oligomer oils used in lubricants. For example, the PAO oils may be derived from monomers having from about 4 to about 30 carbon atoms or from about 10 to about 28 carbon atoms. Examples of useful PAOs include those derived from octene, decene, mixtures thereof and the like.

If desired, the lubricating oil composition of the present invention can contain minor mounts of other base oil components. For example, the lubricating oil composition can contain a minor amount of an ester base oil (Group V base oil) or mixtures thereof. Useful esters include synthetic esters such as the esters of monocarboxylic and polycarboxylic acids with monohydroxy alcohols and polyols. For example, useful esters can be esters of carboxylic or dicarboxylic acids having from about 5 to about 12 carbon atoms, e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like. In general, the ester base oil will have a Kv at 100° C. in the range of about 3 to about 15 cSt. In one embodiment, the ester base oil will have a Kv at 100° C. in the range of about 3 to about 5.5 cSt In general, the ester base oil can be present in the lubricating oil composition in an amount ranging from about 0 to about 15 wt. %, based on the total weight of the base oil composition. In one embodiment, the ester base oil can be present in the lubricating oil composition in an amount ranging from about 0.5 to about 15 wt. %, based on the total weight of the base oil composition. In one embodiment, the ester base oil can be present in the lubricating oil composition in an amount ranging from about 1 to about 10 wt. %, based on the total weight of the base oil composition.

Mannich Reaction Product

The lubricating oil composition of the present invention will further contain about 1.5 wt. % to about 10 wt. %, based on the total weight of the lubricating oil composition, of at least one Mannich reaction product prepared by the condensation of a polyisobutyl-substituted hydroxyaromatic compound, wherein the polyisobutyl group is derived from polyisobutene containing at least about 70 wt. % methylvinylidene isomer and has a number average molecular weight in the range of from about 400 to about 2,500, an aldehyde, an amino acid or ester derivative thereof, and an alkali metal base. In general, the principal Mannich condensation product can be represented by the structure of formula I:

I

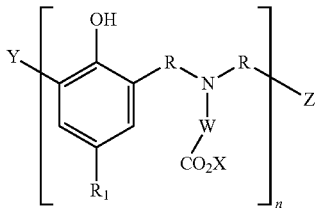

wherein each R is independently —CHR'—, R' is a branched or linear alkyl having one carbon atom to about 10 carbon atoms, a cycloalkyl having from about 3 carbon atoms to about 10 carbon atoms, an aryl having from about 6 carbon atoms to about 10 carbon atoms, an alkaryl having from about 7 carbon atoms to about 20 carbon atoms, or aralkyl having from about 7 carbon atoms to about 20 carbon atoms, $R_1$ is a polyisobutyl group derived from polyisobutene containing at least about 70 wt. % methylvinylidene isomer and having a number average molecular weight in the range of about 400 to about 2,500;

X is hydrogen, an alkali metal ion or alkyl having one to about 6 carbon atoms;

W is —[CHR"]—$_m$ wherein each R" is independently H, alkyl having one carbon atom to about 15 carbon atoms, or a substituted-alkyl having one carbon atom to about 10 carbon atoms and one or more substituents selected from the group consisting of amino, amido, benzyl, carboxyl, hydroxyl, hydroxyphenyl, imidazolyl, imino, phenyl, sulfide, or thiol; and m is an integer from 1 to 4;

Y is hydrogen, alkyl having one carbon atom to about 10 carbon atoms, —CHR'OH, wherein R' is as defined above, or

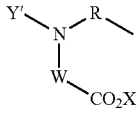

wherein Y' is —CHR'OH, wherein R' is as defined above; and R, X, and W are as defined above;

Z is hydroxyl, a hydroxyphenyl group of the formula:

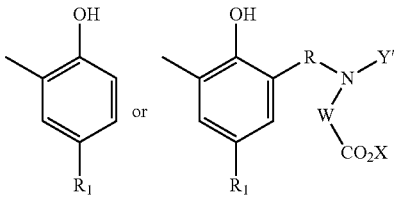

wherein R, $R_1$, Y', X, and W are as defined above, and n is an integer from 0 to 20, with the proviso that when n=0, Z must be:

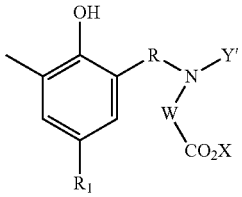

wherein R, $R_1$, Y', X, and W are as defined above.

In one embodiment, the $R_1$ polyisobutyl group has a number average molecular weight of about 500 to about 2,500. In one embodiment, the $R_1$ polyisobutyl group has a number average molecular weight of about 700 to about 1,500. In one embodiment, the $R_1$ polyisobutyl group has a number average molecular weight of about 700 to about 1,100. In one embodiment, the $R_1$ polyisobutyl group is derived from polyisobutene containing at least about 70 weight percent methylvinylidene isomer. In one embodiment, the $R_1$ polyisobutyl group is derived from polyisobutene containing at least about 90 wt. % methylvinylidene isomer.

In the compound of formula I above, X is an alkali metal ion and most preferably a sodium or potassium ion. In another embodiment, in the compound of formula I above, X is alkyl selected from methyl or ethyl.

In one embodiment, R is $CH_2$, $R_1$ is derived from polyisobutene containing at least about 70 weight percent methylvinylidene isomer and a number average molecular weight in the range of about 700 to about 1,100, W is $CH_2$, X is sodium ion and n is 0 to 20.

The Mannich condensation products for use in the lubricating oil composition of the present invention can be prepared by combining under reaction conditions a polyisobutyl-substituted hydroxyaromatic compound, wherein the polyisobutyl group has a number average molecular weight in the range of from about 400 to about 2,500, an aldehyde, an amino acid or ester derivative thereof, and an alkali metal base. In one embodiment, Mannich condensation product prepared by the Mannich condensation of:

(a) a polyisobutyl-substituted hydroxyaromatic compound having the formula:

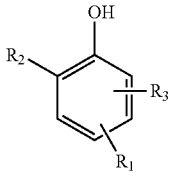

wherein $R_1$ is a polyisobutyl group derived from polyisobutene containing at least about 70 wt. % methylvinylidene isomer and having a number average molecular weight in the range of about 400 to about 2,500, $R_2$ is hydrogen or lower alkyl having one carbon atom to about 10 carbon atoms, and $R_3$ is hydrogen or —OH;

(b) a formaldehyde or an aldehyde having the formula:

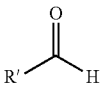

wherein R' is branched or linear alkyl having one carbon atom to about 10 carbon atoms, cycloalkyl having from about 3 carbon atoms to about 10 carbon atoms, aryl having from about 6 carbon atoms to about 10 carbon atoms, alkaryl having from about 7 carbon atoms to about 20 carbon atoms, or aralkyl having from about 7 carbon atoms to about 20 carbon atoms;

(c) an amino acid or ester derivative thereof having the formula:

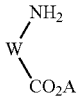

wherein W is —[CHR"]—$_m$ wherein each R" is independently H, alkyl having one carbon atom to about 15 carbon atoms, or a substituted-alkyl having one carbon atom to about 10 carbon atoms and one or more substituents selected from the group consisting of amino, amido, benzyl, carboxyl, hydroxyl, hydroxyphenyl, imidazolyl, imino, phenyl, sulfide, or thiol; and m is an integer from one to 4, and A is hydrogen or alkyl having one carbon atom to about 6 carbon atoms; and (d) an alkali metal base.

Polyisobutyl-Substituted Hydroxyaromatic Compound

A variety of polyisobutyl-substituted hydroxyaromatic compounds can be utilized in the preparation of the Mannich condensation products of this invention. The critical feature is that the polyisobutyl substituent be large enough to impart oil solubility to the finished Mannich condensation product. In general, the number of carbon atoms on the polyisobutyl substituent group that are required to allow for oil solubility of the Mannich condensation product is on the order of about $C_{20}$ and higher. This corresponds to a molecular weight in the range of about 400 to about 2,500. It is desirable that the $C_{20}$ or higher alkyl substituent on the phenol ring be located in the position para to the OH group on the phenol.

The polyisobutyl-substituted hydroxyaromatic compound is typically a polyisobutyl-substituted phenol wherein the polyisobutyl moiety is derived from polyisobutene containing at least about 70 weight percent methylvinylidene isomer and more preferably the polyisobutyl moiety is derived from polyisobutene containing at least about 90 wt. % methylvinylidene isomer. The term "polyisobutyl or polyisobutyl substituent" as used herein refers to the polyisobutyl substituent on the hydroxyaromatic ring. The polyisobutyl substituent has a number average molecular weight in the range of about 400 to about 2,500. In one embodiment, the polyisobutyl moiety has a number average molecular weight in the range of about 450 to about 2,500. In one embodiment, the polyisobutyl moiety has a number average molecular weight in the range of about 700 to about 1,500. In one embodiment, the polyisobutyl moiety has a number average molecular weight in the range of about 700 to about 1,100.

In one preferred embodiment, the attachment of the polyisobutyl substituent to the hydroxyaromatic ring is para to the hydroxyl moiety in at least about 60 percent of the total polyisobutyl-substituted phenol molecules. In one embodiment, the attachment of the polyisobutyl substituent to the hydroxyaromatic ring is para to the hydroxyl moiety in at least about 80 percent of the total polyisobutyl-substituted phenol molecules. In one embodiment, the attachment of the polyisobutyl substituent to the hydroxyaromatic ring is para to the hydroxyl moiety on the phenol ring in at least about 90 percent of the total polyisobutyl-substituted phenol molecules.

Di-substituted phenols are also suitable starting materials for the Mannich condensation products of this invention. Di-substituted phenols are suitable provided that they are substituted in such a way that there is an unsubstituted ortho position on the phenol ring. Examples of suitable di-substituted phenols are o-cresol derivatives substituted in the para position with a $C_{20}$ or greater polyisobutyl substituent and the like.

In one embodiment, a polyisobutyl-substituted phenol has the following formula:

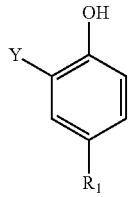

wherein $R_1$ is polyisobutyl group derived from polyisobutene containing at least about 70 weight percent methylvinylidene isomer and having a number average molecular weight in the range of about 400 to about 2,500, and Y is hydrogen.

Suitable polyisobutenes may be prepared using boron trifluoride ($BF_3$) alkylation catalyst as described in U.S. Pat. Nos. 4,152,499 and 4,605,808, the contents of each of these references being incorporated herein by reference. Commercially available polyisobutenes having a high alkylvinylidene content include Glissopal® 1000, 1300 and 2300, available from BASF.

The preferred polyisobutyl-substituted phenol for use in the preparation of the Mannich condensation products is a mono-substituted phenol, wherein the polyisobutyl substituent is attached at the para-position to the phenol ring. However, other polyisobutyl-substituted phenols that may undergo the Mannich condensation reaction may also be used for preparation of the Mannich condensation products according to the present invention.

Solvent

Solvents may be employed to facilitate handling and reaction of the polyisobutyl-substituted phenols in the preparation of the Mannich condensation products. Examples of suitable solvents are hydrocarbon compounds such as heptane, benzene, toluene, chlorobenzene, aromatic solvent, neutral oil of lubricating viscosity, paraffins and naphthenes. Examples of other commercially available suitable solvents that are aromatic mixtures include Chevron® Aromatic 100N, neutral oil, Exxon® 150N, neutral oil.

In one embodiment, the Mannich condensation product may be first dissolved in an alkyl-substituted aromatic solvent. Generally, the alkyl substituent on the aromatic solvent has from about 3 carbon atoms to about 15 carbon atoms. In one embodiment, the alkyl substituent on the aromatic solvent has from about 6 carbon atoms to about 12 carbon atoms.

Aldehydes

Suitable aldehydes for use in forming the Mannich condensation product include formaldehyde or aldehydes having the formula

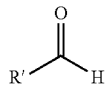

wherein R' is branched or linear alkyl having from one carbon atom to about 10 carbon atoms, cycloalkyl having from about 3 carbon atoms to about 10 carbon atoms, aryl having from about 6 carbon atoms to about 10 carbon atoms, alkaryl having from about 7 carbon atoms to about 20 carbon atoms, or aralkyl having from about 7 carbon atoms to about 20 carbon atoms.

Representative aldehydes include, but are not limited to, aliphatic aldehydes such as formaldehyde, acetaldehyde, propionaldehyde, butyraldehyde, valeraldehyde, caproaldehyde and heptaldehyde. Aromatic aldehydes are also contemplated for use in the preparation of the Mannich condensation products, such as benzaldehyde and alkylbenzaldehyde, e.g., para-tolualdehyde. Also useful are formaldehyde producing reagents, such as paraformaldehyde and aqueous formaldehyde solutions such as formalin.

In one preferred embodiment, an aldehyde for use in the in the preparation of the Mannich condensation products is formaldehyde or formalin. By formaldehyde is meant all its forms, including gaseous, liquid and solid. Examples of gaseous formaldehyde is the monomer $CH_2O$ and the trimer, $(CH_2O)_3$ (trioxane) having the formula given below.

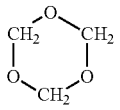

Examples of liquid formaldehyde are the following:

Monomer $CH_2O$ in ethyl ether.

Monomer $CH_2O$ in water which has the formulas $CH_2(H_2O)_2$ (methylene glycol) and $HO(—CH_2O)_n—H$.

Monomer $CH_2O$ in methanol which has the formulas $OHCH_2OCH_3$ and $CH_3O(—CH_2O)_n—H$.

Formaldehyde solutions are commercially available in water and various alcohols. In water it is available as a 37% to 50% solution. Formalin is a 37% solution in water. Formaldehyde is also commercially available as linear and cyclic (trioxane) polymers. Linear polymers may be low molecular weight or high molecular weight polymers.

Amino Acid

Suitable amino acids or ester derivatives thereof for use in forming the Mannich condensation product include amino acids having the formula

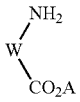

wherein W is $—[CHR'']_m—$, wherein each R" is independently H, alkyl having one carbon atom to about 15 carbon atoms, or a substituted-alkyl having one carbon atom to about 10 carbon atoms and one or more substituents selected from the group consisting of amino, amido, benzyl, carboxyl, hydroxyl, hydroxyphenyl, imidazolyl, imino, phenyl, sulfide, or thiol; and m is an integer from one to 4, and A is hydrogen or alkyl having one carbon atom to about 6 carbon atoms. Preferably the alkyl is methyl or ethyl.

In one embodiment, the amino acid is glycine.

The term "amino acid salt" as used herein refers to salts of amino acids having the formula

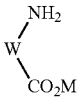

wherein W is as defined above and M is an alkali metal ion. Preferably M is a sodium ion or a potassium ion. More preferably X is a sodium ion.

Some examples of alpha amino acids contemplated for use in the preparation of the Mannich condensation product are given below in Table I.

TABLE I

| Name | Formula | Log $K^{25°\ C.,\ 0\ ionic\ strength}$ |
|---|---|---|
| Alanine | 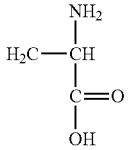 | 9.87 |
| Arginine | 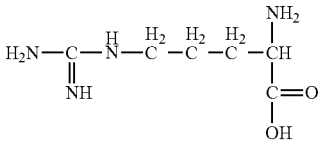 | 8.99 |
| Asparagine | 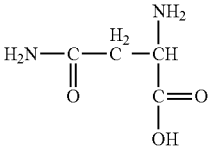 | 8.72 * |
| Aspartic Acid | 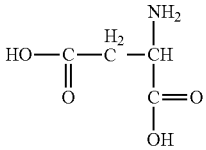 | 10.0 |
| Cysteine | 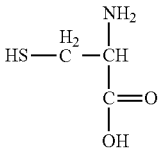 | 10.77 |
| Cystine | 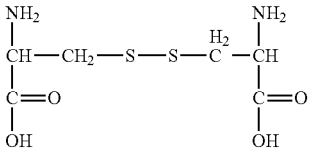 | 8.80 ** |
| Glutamic Acid | 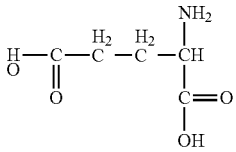 | 9.95 |
| Glutamine | 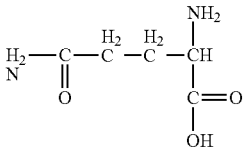 | 9.01 * |
| Glycine | 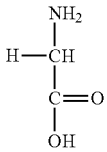 | 9.78 |

TABLE I-continued

| Name | Formula | Log $K^{25° C., 0 ionic strength}$ |
|---|---|---|
| Histidine | 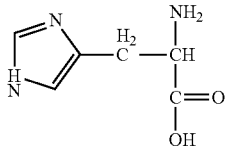 | 9.08 * |
| Hydroxy-lysine | 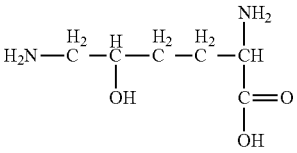 | |
| Isoleucine | 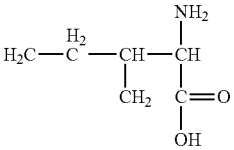 | 9.75 |
| Leucine | 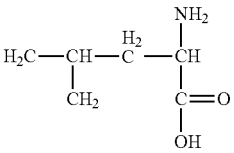 | 9.75 |
| Lysine | 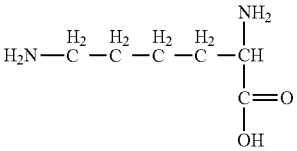 | 10.69 * |
| Methionine | 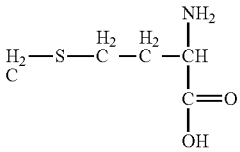 | 9.05 |
| Phenyl-alanine | 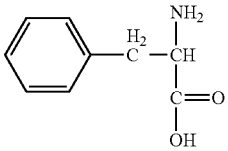 | 9.31 |
| Serine | 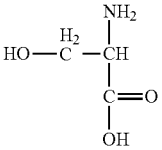 | 9.21 |
| Threonine | 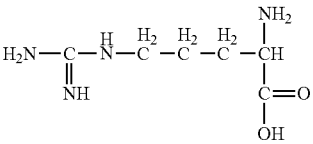 | 9.10 |

TABLE I-continued

| Name | Formula | Log $K^{25° C., 0 ionic strength}$ |
|---|---|---|
| Tyrosine | 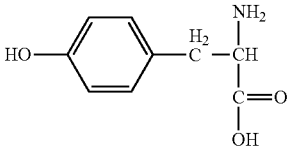 | 10.47 |
| Valine | 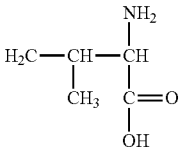 | 9.72 |

* 0.1 ionic strength.

** 20° C. and 0.1 ionic strength.

Alkali Metal Base

Suitable alkali metal base for use in forming the Mannich condensation product include alkali metal hydroxides, alkali metal alkoxides and the like. In one embodiment, the alkali metal base is an alkali metal hydroxide selected from the group consisting of sodium hydroxide, lithium hydroxide or potassium hydroxide.

In one embodiment, the amino acid may be added in the form of its alkali metal ion salt. In one embodiment, the alkali metal ion is a sodium ion or a potassium ion. In one preferred embodiment, the alkali metal ion is a sodium ion.

General Procedure for Preparation of Mannich Condensation Product

The reaction to form the Mannich condensation products can be carried out batch wise, or in continuous or semi-continuous mode. Normally the pressure for this reaction is atmospheric, but the reaction may be carried out under sub atmospheric or super atmospheric pressure if desired.

The temperature for this reaction may vary widely. The temperature range for this reaction can vary from about 10° C. to about 200° C., or from about 50° C. to about 150° C., or from about 70° C. to about 130° C.

The reaction may be carried out in the presence of a diluent or a mixture of diluents. It is important to ensure that the reactants come into intimate contact with each other in order for them to react. This is an important consideration because the starting materials for the Mannich condensation products include the relatively non polar polyisobutyl-substituted hydroxyl aromatic compounds and the relatively polar amino acid or ester derivative thereof. It is therefore necessary to find a suitable set of reaction conditions or diluents that will dissolve all the starting materials.

Diluents for this reaction must be capable of dissolving the starting materials of this reaction and allowing the reacting materials to come in contact with each other. Mixtures of diluents can be used for this reaction. Useful diluents for this reaction include water, alcohols, (including methanol, ethanol, isopropanol, 1-propanol, 1-butanol, isobutanol, sec-butanol, butanediol, 2-ethylhexanol, 1-pentanol, 1-hexanol, ethylene glycol, and the like), DMSO, NMP, HMPA, cellosolve, diglyme, various ethers (including diethyl ether, THF, diphenylether, dioxane, and the like), aromatic diluents (including toluene, benzene, o-xylene, m-xylene, p-xylene, mesitylene and the like), esters, alkanes (including pentane, hexane, heptane, octane, and the like), and various natural and synthetic diluent oils (including 100 neutral oils, 150 neutral oils, polyalphaolefins, Fischer- Tropsch derived base oil and the like, and mixtures of these diluents. Mixtures of diluents that form two phases such as methanol and heptane are suitable diluents for this reaction.

The reaction may be carried out by first reacting the hydroxyaromatic compound with the alkali metal base, followed by the addition of the amino acid or ester derivative thereof and the aldehyde, or the amino acid or ester derivative thereof may be reacted with the aldehyde followed by the addition of the hydroxyaromatic compound and the alkali metal base, etc.

It is believed that the reaction of the amino acid, such as glycine, or ester derivative thereof, plus the aldehyde, such as formaldehyde, may produce the intermediate formula

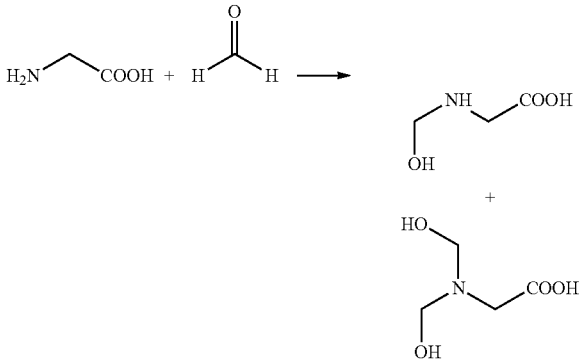

which may ultimately form the cyclic formula

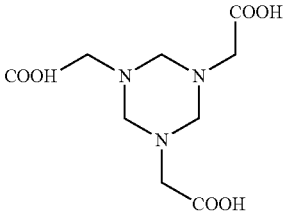

It is believed that these intermediates may react with the hydroxyaromatic compound and the base to form the Mannich condensation products of the present invention.

Alternatively, it is believed that the reaction of the hydroxyaromatic compound with the aldehyde may produce the intermediate formula

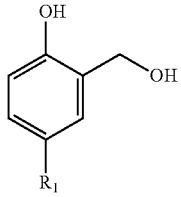

It is also believed that this intermediate may react with the amino acid or ester derivative thereof and the base to form the Mannich condensation product of the present invention.

The time of the reaction can vary widely depending on the temperature. The reaction time can vary between about 0.1 hour to about 20 hours, or from about 2 hours to about 10 hours, or from about 3 hours to about 7 hours.

The charge mole ratio (CMR) of the reagents can also vary over a wide range. Table I below gives a listing of the different formulae that can arise if different charge mole ratios are used. At a minimum the oil-soluble Mannich condensation products should preferable contain at least one polyisobutyl-substituted phenol ring and one amino acid group connected by one aldehyde group and one alkali metal. The polyisobutyl-substituted phenol/aldehyde/amino acid/base charge mole ratio for this molecule, also shown in Table II below, is 1.0:1.0:1.0:1.0. Other charge mole ratios are possible and the use of other charge mole ratios can lead to the production of different molecules of different formulas.

TABLE II

| Product | Polyisobutyl-substituted phenol:aldehyde: amino acid:base ((CMR) |
|---|---|
| 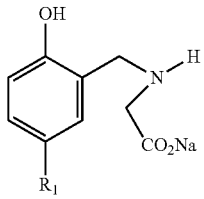 | 1.0:1.0:1.0:10 |
| 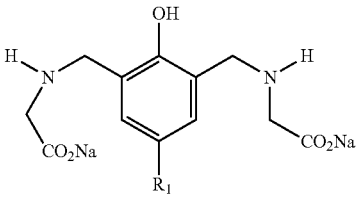 | 1.0:2.0:2.0:2.0 |

TABLE II-continued

| Product | Polyisobutyl-substituted phenol:aldehyde: amino acid:base ((CMR) |
|---|---|
| 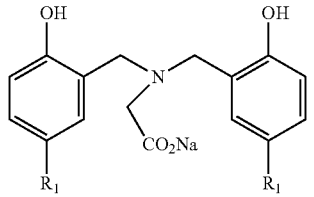 | 2.0:2.0:1.0:1.0 |
| 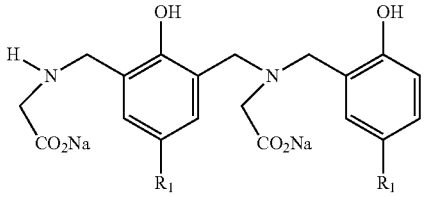 | 2.0:3.0:2.0:2:0 |
| 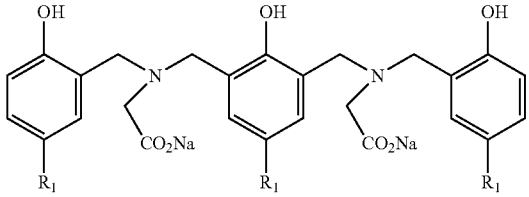 | 3:0:4.0:2.0:2.0 |

Ashless Dispersant

The lubricating oil composition of the present invention will further contain at least one ashless dispersant other than the Mannich reaction product discussed hereinabove. In general, a suitable ashless dispersant can be polyalkylene succinic anhydride ashless dispersants, non-nitrogen containing ashless dispersants and basic nitrogen-containing ashless dispersants. One other such group suitable for use herein as a dispersing agent includes copolymers which contain a carboxylate ester with one or more additional polar function, including amine, amide, imine, imide, hydroxyl, carboxyl, and the like. These products can be prepared by copolymerization of long chain alkyl acrylates or methacrylates with monomers of the above function. Such groups include alkyl methacrylate-vinyl pyrrolidinone copolymers, alkyl methacrylate-dialkylaminoethylmethacrylate copolymers and the like as well as high molecular weight amides and polyamides or esters and polyesters such as tetraethylene pentamine, polyvinyl polystearates and other polystearamides.

The polyalkylene succinic anhydride ashless dispersants include polyisobutenyl succinic anhydrides (PIBSA). The number average molecular weight of the polyalkylene tail in the polyalkylene succinic anhydrides used herein will be at least about 350 or from about 750 to about 3000 or from about 900 to about 1100.

In one embodiment, a mixture of polyalkylene succinic anhydrides is employed. In this embodiment, the mixture can comprise a low molecular weight polyalkylene succinic anhydride component e.g., a polyalkylene succinic anhydride having a number average molecular weight of from about 350 to about 1000, and a high molecular weight polyalkylene succinic anhydride component, e.g., a polyalkylene succinic anhydride having a number average molecular weight of from about 1000 to about 3000. In one embodiment, both the low and high molecular weight components are polyisobutenyl succinic anhydrides. Alternatively, various molecular weights polyalkylene succinic anhydride components can be combined as a dispersant as well as a mixture of the other above referenced dispersants as identified above.

In general, the polyalkylene succinic anhydride is obtained from a reaction product of a polyalkylene such as polyisobutene with maleic anhydride. One can use conventional polyisobutene, or high methylvinylidene polyisobutene in the preparation of such polyalkylene succinic anhydrides. The polyalkylene succinic anhydrides can be prepared using conventional techniques e.g., thermal, chlorination, free radical, acid catalyzed, or any other process in this preparation that is within the purview of one skilled in the art. Examples of suitable polyalkylene succinic anhydrides for use herein are thermal PIBSA (polyisobutenyl succinic anhydride) described in U.S. Pat. No. 3,361,673; chlorinated PIBSA described in U.S. Pat. No. 3,172,892; a mixture of thermal and chlorinated PIBSA described in U.S. Pat. No. 3,912,764; high succinic ratio PIBSA described in U.S. Pat. No. 4,234,435; polyPIBSA described in U.S. Pat. Nos. 5,112,507 and 5,175,225; high succinic ratio polyPIBSA described in U.S. Pat. Nos. 5,565,528 and 5,616,668; free radical PIBSA described in U.S. Pat. Nos. 5,286,799, 5,319,030 and 5,625,004; PIBSA made from high methylvinylidene polybutene described in U.S. Pat. Nos. 4,152,499, 5,137,978 and 5,137,980; high succinic ratio PIBSA made from high methylvinylidene polybutene described in European Patent Application Publication No. EP 355 895; terpolymer PIBSA described in U.S. Pat. No. 5,792,729, sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863, the contents of each of these references being incorporated herein by reference.

Non-nitrogen containing ashless dispersants include derivatives of polyalkylene succinic anhydrides such as, for example, succinic acids, Group I and/or Group II mono- or di-metal salts of succinic acids, succinate esters formed by the reaction of a polyalkylene succinic anhydride, acid chloride, or other derivatives with an alcohol (e.g., $HOR^1$ wherein $R^1$ is an alkyl group of from 1 to 10 carbon atoms) and the like and mixtures thereof.

If desired, the foregoing polyalkylene succinic anhydride ashless dispersants and/or non-nitrogen-containing ashless dispersants can be post-treated with a wide variety of post-treating reagents. For example, the foregoing polyalkylene succinic anhydride and/or non-nitrogen-containing ashless dispersants can be reacted with a cyclic carbonate under conditions sufficient to cause reaction of the cyclic carbonates with a hydroxyl group. The reaction is ordinarily conducted at temperatures ranging from about 0° C. to about 250° C., or from about 100° C. to about 200° C. or from about 50° C. to about 180° C.

The reaction may be conducted neat, wherein the polyalkylene succinic anhydride or non-nitrogen-containing ashless dispersant and the cyclic carbonate are combined in the proper ratio, either alone or in the present of a catalyst (e.g., an acidic, basic or Lewis acid catalyst). Examples of suitable catalysts include, but are not limited to, phosphoric acid, boron trifluoride, alkyl or aryl sulfonic acid, alkali or alkaline carbonate. The same solvents or diluents as described above with respect to the preparing the polyalkylene succinic anhydride may also be used in the cyclic carbonate post-treatment. In one preferred embodiment, a cyclic carbonate for use herein is 1,3-dioxolan-2-one (ethylene carbonate).

Nitrogen-containing basic ashless (metal-free) dispersants contribute to the base number or BN (as can be measured by ASTM D 2896) of a lubricating oil composition to which they are added, without introducing additional sulfated ash. The basic nitrogen compound used to prepare the colloidal suspensions of the present invention must contain basic nitrogen as measured by ASTM D664 test or D2896. It is preferably oil-soluble. The basic nitrogen compounds are selected from the group consisting of succinimides, polysuccinimides, carboxylic acid amides, hydrocarbyl monoamines, hydrocarbon polyamines, Mannich condensation products of hydrocarbyl-substituted phenols, formaldehyde and polyamines other than the Mannich reaction product discussed herein above, phosphoramides, thiophosphoramides, phosphonamides, dispersant viscosity index improvers, and mixtures thereof. These basic nitrogen-containing compounds are described below (keeping in mind the reservation that each must have at least one basic nitrogen). Any of the nitrogen-containing compositions may be post-treated with, e.g., boron, using procedures well known in the art so long as the compositions continue to contain basic nitrogen.

The succinimide and polysuccinimide ashless dispersants that can be used in the lubricating oil compositions of the present invention are disclosed in numerous references and are well known in the art. Certain fundamental types of succinimides and the related materials encompassed by the term of art "succinimide" are taught in, for example, U.S. Pat. Nos. 3,219,666; 3,172,892; 3,272,746; 4,234,435 and 6,165,235, the contents of which are incorporated by reference herein. Succinic-based dispersants have a wide variety of chemical structures. One class of succinic-based dispersants may be represented by the formula:

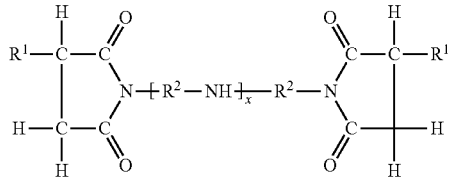

wherein each $R^1$ is independently a hydrocarbyl group, such as a polyolefin-derived group. Typically the hydrocarbyl group is an alkyl group, such as a polyisobutyl group. Alternatively expressed, the $R^1$ groups can contain about 40 to about 500 carbon atoms, and these atoms may be present in aliphatic forms. $R^2$ is an alkylene group, commonly an ethylene ($C_2H_4$) group.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

The term "succinimide" is understood in the art to include many of the amide, imide, and amidine species which may also be formed. The predominant product, however, is a succinimide and this term has been generally accepted as meaning the product of a reaction of an alkenyl substituted succinic acid or anhydride with a nitrogen-containing compound. In one preferred embodiment, a succinimide, because of its commercial availability, are those succinimides prepared from a hydrocarbyl succinic anhydride, wherein the hydrocarbyl group contains from about 24 to about 350 carbon atoms, and an ethylene amine or polyamine, the ethylene amines being especially characterized by ethylene diamine, diethylene triamine, triethylene tetramine, tetraethylene pentamine, and higher molecular weight polyethylene amines. Particularly preferred are those succinimides prepared from polyisobutenyl succinic anhydride of 70 to 128 carbon atoms and tetraethylene pentamine or higher molecular weight polyethylene amines or mixtures of polyethylene amines such that the average molecular weight of the mixture is about 205 Daltons. In one embodiment of the present invention, an ashless dispersant for use in the lubricating oil composition is a bis-succinimide derived from a polyisobutenyl group having a number average molecular weight of about 700 to about 2300.

Also included within the term "succinimide" are the co-oligomers of a hydrocarbyl succinic acid or anhydride and a polysecondary amine containing at least one tertiary amino nitrogen in addition to two or more secondary amino groups. Ordinarily, this composition has between 1,500 and 50,000 average molecular weight. A typical compound would be that prepared by reacting polyisobutenyl succinic anhydride and ethylene dipiperazine.

If desired, the foregoing succinimides and polysuccinimide ashless dispersants can be post-treated with a wide variety of post-treating reagents, e.g., with a cyclic carbonate, as discussed hereinabove. The resulting post-treated product has one or more nitrogens of the polyamino moiety substituted with a hydroxy hydrocarbyl oxycarbonyl, a hydroxy poly(oxyalkylene) oxycarbonyl, a hydroxyalkylene, hydroxyalkylenepoly(oxyalkylene), or mixture thereof.

The foregoing succinimides and polysuccinimides, including the post-treated compositions described above, can also be reacted to form borated dispersants. In addition to boric acid, examples of suitable boron compounds include boron oxides, boron halides and esters of boric acid. Generally, from about 0.1 equivalent to about 1 equivalent of boron compound per equivalent of basic nitrogen or hydroxyl in the compositions of this invention may be employed.

Carboxylic acid amide ashless dispersants are also useful nitrogen-containing ashless dispersants. Typical of such compounds are those disclosed in U.S. Pat. No. 3,405,064, the contents of which are incorporated by reference herein. These compounds are ordinarily prepared by reacting a carboxylic acid or anhydride or ester thereof, having at least 12 to about 350 aliphatic carbon atoms in the principal aliphatic chain and, if desired, having sufficient pendant aliphatic groups to render the molecule oil soluble with an amine or a hydrocarbyl polyamine, such as an ethylene amine, to give a mono or polycarboxylic acid amide. In one embodiment, a carboxylic amide can be prepared from (1) a carboxylic acid of the formula $R^2COOH$, where $R^2$ is $C_{12-20}$ alkyl or a mixture of this acid with a polyisobutenyl carboxylic acid in which the polyisobutenyl group contains from 72 to 128 carbon atoms and (2) an ethylene polyamine, especially triethylene tetramine or tetraethylene pentamine or mixtures thereof.

Another class of useful nitrogen-containing ashless dispersants are hydrocarbyl monoamines and hydrocarbyl polyamines, preferably of the type disclosed in U.S. Pat. No. 3,574,576, the contents of which are incorporated by reference herein. The hydrocarbyl group, which is preferably alkyl, or olefinic having one or two sites of unsaturation, usually contains from 9 to about 350, or from about 20 to about 200 carbon atoms. In one embodiment, suitable hydrocarbyl polyamines are those which are derived, e.g., by reacting polyisobutenyl chloride and a polyalkylene polyamine, such as an ethylene amine, e.g., ethylene diamine, diethylene triamine, tetraethylene pentamine, 2-aminoethylpiperazine, 1,3-propylene diamine, 1,2-propylenediamine, and the like.

Yet another class of useful nitrogen-containing ashless dispersants is the Mannich compounds other than the Mannich reaction products discussed herein above. These compounds are prepared from a phenol or $C_{9-200}$ alkylphenol, an aldehyde, such as formaldehyde or formaldehyde precursor such as paraformaldehyde, and an amine compound. The amine may be a mono or polyamine and typical compounds are prepared from an alkylamine, such as methylamine or an ethylene amine, such as, diethylene triamine, or tetraethylene pentamine, and the like. The phenolic material may be sulfurized and preferably is dodecylphenol or a $C_{80-100}$ alkylphenol. Typical Mannich bases which can be used in this invention are disclosed in U.S. Pat. Nos. 3,539,663, 3,649,229; 3,368,972 and 4,157,309, the contents of which are incorporated by reference herein. U.S. Pat. No. 3,539,663, the contents of which are incorporated by reference herein, discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of 2 to 6 carbon atoms and n is 1-10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the compound.

Still yet another class of useful nitrogen-containing ashless dispersants is the phosphoramides and phosphonamides such as those disclosed in U.S. Pat. Nos. 3,909,430 and 3,968,157, the contents of which are incorporated by reference herein. These compounds may be prepared by forming a phosphorus compound having at least one P—N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoramides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly an alkylamine, alkyldiamine, alkylpolyamine, or an alkyleneamine, such as ethylene diamine, diethylenetriamine, triethylenetetramine, tetraethylenepentamine, and the like.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804, the contents of which are incorporated by reference herein.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730, the contents of which are incorporated by reference herein.

In general, the ashless dispersants will be present in the lubricating oil compositions of the present invention in an amount ranging from about 0.1 to about 10 wt. %, based on the total weight of the lubricating oil composition. In one embodiment, the ashless dispersants will be present in the lubricating oil compositions of the present invention in an amount ranging from about 1 to about 8 wt. %, based on the total weight of the lubricating oil composition The lubricating oil compositions of the present invention may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and the like and mixtures thereof. A variety of the additives are known and commercially available. These additives, or their analogous compounds, can be employed for the preparation of the lubricating oil compositions of the invention by the usual blending procedures.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, based on the total weight of the lubricating oil composition.

The lubricating oil composition of the present invention can contain one or more antioxidants that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines such as bis-nonylated diphenylamine, bis-octylated diphenylamine, and octylated/butylated diphenylamine, phenyl-α-naphthylamine, alkyl or arylalkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition.

The lubricating oil composition of the present invention can contain a detergent. Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts. A large amount of a metal base may be incorporated by reacting excess metal compound (e.g., an oxide or hydroxide) with an acidic gas (e.g., carbon dioxide).

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium.

Commercial products are generally referred to as neutral or overbased. Overbased metal detergents are generally produced by carbonating a mixture of hydrocarbons, detergent acid, for example: sulfonic acid, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Overbased detergents may be low overbased, e.g., an overbased salt having a BN below 100. In one embodiment, the BN of a low overbased salt may be from about 5 to about 50. In another embodiment, the BN of a low overbased salt may be from about 10 to about 30. In yet another embodiment, the BN of a low overbased salt may be from about 15 to about 20.

Overbased detergents may be medium overbased, e.g., an overbased salt having a BN from about 100 to about 250. In one embodiment, the BN of a medium overbased salt may be from about 100 to about 200. In another embodiment, the BN of a medium overbased salt may be from about 125 to about 175.

Overbased detergents may be high overbased, e.g., an overbased salt having a BN above 250. In one embodiment, the BN of a high overbased salt may be from about 250 to about 550.

In one embodiment, the detergent can be one or more alkali or alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

The alkyl substituted moiety of the alkali or alkaline earth metal salt of an alkyl-substituted hydroxyaromatic carboxylic acid is derived from an alpha olefin having from about 10 to about 80 carbon atoms. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 12 to about 30 carbon atoms per molecule. In one embodiment, the normal alpha olefins are isomerized using at least one of a solid or liquid catalyst.

In another embodiment, the olefins are a branched olefinic propylene oligomer or mixture thereof having from about 20 to about 80 carbon atoms, i.e., branched chain olefins derived from the polymerization of propylene. The olefins may also be substituted with other functional groups, such as hydroxy groups, carboxylic acid groups, heteroatoms, and the like. In one embodiment, the branched olefinic propylene oligomer or mixtures thereof have from about 20 to about 60 carbon atoms. In one embodiment, the branched olefinic propylene oligomer or mixtures thereof have from about 20 to about 40 carbon atoms.

In one embodiment, at least about 75 mole % (e.g., at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkaline earth metal salt of an alkyl-substituted hydroxybenzoic acid detergent are a $C_{20}$ or higher. In another embodiment, the alkali or alkaline earth metal salt of an alkyl-substituted hydroxyaromatic carboxylic acid is an alkali or alkaline earth metal salt of an alkyl-substituted hydroxybenzoic acid that is derived from an alkyl-substituted hydroxybenzoic acid in which the alkyl groups are the residue of normal alpha-olefins containing at least 75 mole % $C_{20}$ or higher normal alpha-olefins.

In another embodiment, at least about 50 mole % (e.g., at least about 60 mole %, at least about 70 mole %, at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkali or alkaline earth metal salt of an alkyl-substituted hydroxybenzoic acid are about $C_{14}$ to about $C_{18}$.

The resulting alkali or alkaline earth metal salt of an alkyl-substituted hydroxyaromatic carboxylic acid will be a mixture of ortho and para isomers. In one embodiment, the product will contain about 1 to 99% ortho isomer and 99 to 1% para isomer. In another embodiment, the product will contain about 5 to 70% ortho and 95 to 30% para isomer.

The alkali or alkaline earth metal salts of an alkyl-substituted hydroxyaromatic carboxylic acid can be neutral or overbased. Generally, an overbased alkali or alkaline earth metal salt of an alkyl-substituted hydroxyaromatic carboxylic acid is one in which the BN of the alkali or alkaline earth metal salts of an alkyl-substituted hydroxyaromatic carboxylic acid has been increased by a process such as the addition of a base source (e.g., lime) and an acidic overbasing compound (e.g., carbon dioxide).

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to about 220 wt. % (preferably at least about 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Generally, the amount of the additional detergent can be from about 0.001 wt. % to about 25 wt. %, from about 0.05 wt. % to about 20 wt. %, or from about 0.1 wt. % to about 15 wt. %, based on the total weight of the lubricating oil composition.

The lubricating oil composition of the present invention can contain one or more friction modifiers that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, or a $C_6$ to $C_{24}$, or a $C_6$ to $C_{20}$, fatty acid ester and a nitrogen-containing compound selected from the group consisting of ammonia, and an alkanolamine and the like and mixtures thereof. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition.

The lubricating oil composition of the present invention can contain one or more anti-wear agents that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphates, metal (e.g., Zn, Pb, Sb, Mo and the like) salts of dithiocarbamates, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphorus content. In some embodiments, the phosphorus content of the lubricating oil composition disclosed herein is from about 0.01 wt. % to about 0.14 wt., based on the total weight of the lubricating oil composition.

The lubricating oil composition of the present invention can contain one or more foam inhibitors or anti-foam inhibitors that can break up foams in oils. Any foam inhibitor or anti-foam known by a person of ordinary skill in the art may be used in the lubricating oil composition. Non-limiting examples of suitable foam inhibitors or anti-foam inhibitors include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the foam inhibitors or anti-foam inhibitors comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the foam inhibitors or anti-foam inhibitors may vary from about 0.001 wt. % to about 5 wt. %, from about 0.05 wt. % to about 3 wt. %, or from about 0.1 wt. % to about 1 wt. %, based on the total weight of the lubricating oil composition.

The lubricating oil composition of the present invention can contain one or more pour point depressants that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition.

In one embodiment, the lubricating oil composition of the present invention does not contain one or more demulsifiers. In another embodiment, the lubricating oil composition of the present invention can contain one or more demulsifiers that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkyl phenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition.

The lubricating oil composition of the present invention can contain one or more corrosion inhibitors that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition.

The lubricating oil composition of the present invention can contain one or more extreme pressure (EP) agents that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition.

The lubricating oil composition of the present invention can contain one or more rust inhibitors that can inhibit the corrosion of ferrous metal surfaces. Any rust inhibitor known by a person of ordinary skill in the art may be used in the lubricating oil composition. Non-limiting examples of suitable rust inhibitors include nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

The lubricating oil composition of the present invention can contain one or more multifunctional additives. Non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

The lubricating oil composition of the present invention can contain one or more viscosity index improvers. Non-limiting examples of suitable viscosity index improvers include, but are not limited to, olefin copolymers, such as ethylene-propylene copolymers, styrene-isoprene copolymers, hydrated styrene-isoprene copolymers, polybutene, polyisobutylene, polymethacrylates, vinylpyrrolidone and methacrylate copolymers and dispersant type viscosity index improvers. These viscosity modifiers can optionally be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers). Other examples of viscosity modifiers include star polymers (e.g., a star polymer comprising isoprene/styrene/isoprene triblock). Yet other examples of viscosity modifiers include poly alkyl(meth)acrylates of low Brookfield viscosity and high shear stability, functionalized poly alkyl(meth)acrylates with dispersant properties of high Brookfield viscosity and high shear stability, polyisobutylene having a weight average molecular weight ranging from 700 to 2,500 Daltons and mixtures thereof. The amount of the viscosity index improvers may vary from about 0.01 wt. % to about 25 wt.

%, from about 0.05 wt. % to about 20 wt. %, or from about 0.3 wt. % to about 15 wt. %, based on the total weight of the lubricating oil composition.

The lubricating oil composition of the present invention can contain one or more metal deactivators. Non-limiting examples of suitable metal deactivators include disalicylidene propylenediamine, triazole derivatives, thiadiazole derivatives, and mercaptobenzimidazoles.

If desired, the at least one Mannich reaction product (c) and/or at least one ashless dispersant (d) may be provided alone or together as an additive package or concentrate in which the at least one Mannich reaction product (c) and/or at least one ashless dispersant (d) and optionally with the foregoing lubricant additives are incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will typically contain one or more of the various additives, referred to above, in the desired amounts and ratios to facilitate direct combination with the requisite amount of the oil of lubricating viscosity.

The lubricating oil composition disclosed herein is used to lubricate an internal combustion engine such as a spark ignition engine, or a compression ignition diesel engine, e.g., a heavy duty diesel engine or a compression ignition diesel engine equipped with at least one of an exhaust gas recirculation (EGR) system; a catalytic converter; and a particulate trap. Such a motor oil composition may be used to lubricate all major moving parts in any reciprocating internal combustion engine, reciprocating compressors and in steam engines of crankcase design. In automotive applications, the motor oil composition may also be used to cool hot engine parts, keep the engine free of rust and deposits, and seal the rings and valves against leakage of combustion gases.

The primary service classes for a heavy duty diesel engine are light, medium, and heavy heavy-duty diesel engines as disclosed in US 40 CFR 86.090-2. The classification is based on factors such as vehicle gross vehicle weight (GVW), vehicle usage and operating patterns, other vehicle design characteristics, engine horsepower, and other engine design and operating characteristics. The following is a general description of the primary service classes for a heavy duty diesel engine:

(1) Light heavy duty diesel engines usually are non-sleeved and not designed for rebuild; their rated horsepower generally ranges from 70 to 170. Vehicle body types in this group may include any heavy-duty vehicle built for a light-duty truck chassis, van trucks, multi-stop vans, recreational vehicles, and some single axle straight trucks. Typical applications of such engines include personal transportation, light-load commercial hauling and delivery, passenger service, agriculture, and construction. The engines in this group are normally used in vehicles whose GVW is normally less than 19,500 lbs.

(2) Medium heavy duty diesel engines may be sleeved or non-sleeved and may be designed for rebuild; their rated horsepower generally ranges from 170 to 250. Vehicle body types in this group may include school buses, tandem axle straight trucks, city tractors, and a variety of special purpose vehicles such as small dump trucks, and trash compactor trucks. Typical applications of such engines include commercial short haul and intra-city delivery and pickup. The engines in this group are normally used in vehicles whose GVW varies from 19,500 to 33,000 lbs.

(3) Heavy heavy duty diesel engines are sleeved and designed for multiple rebuilds; their rated horsepower generally exceeds 250. Vehicles body types in this group may include tractors, trucks, and buses used in inter-city, long-haul applications. The engines in this group are normally used in vehicles whose GVW exceed 33,000 lbs.

The following non-limiting examples are illustrative of the present invention.

Oil A, Oil B, Oil C, Oil D, Comparative Oil 1, Comparative Oil 2, and Comparative Oil 3 were prepared and tested for piston cleanliness and tendency to piston ring sticking according to the Volkswagen Turbocharged DI test, a European passenger car diesel engine test (CEC-L-78-T-99), which is part of the ACEA A/B and C specification promulgated by the European Automobile Manufacturers Association in 2004. This test was used to simulate repeated cycles of high-speed operation followed by idling. A Volkswagen 1.9 liter, inline, four-cylinder turbocharged direct injection automotive diesel engine (VW TDi) was mounted on an engine dynamometer stand. A 54-hour, 2-phased procedure that cycles between 30 minutes of 40° C. oil sump at idle and 150 minutes of 145° C. oil sump at full power (4150 rpm) was carried out without interim oil top-ups. After the procedure, the pistons were rated for carbon and lacquer deposits, as well for groove carbon filling. The piston rings were evaluated for ring sticking. The results are set forth below in Tables III and IV. Each of Oils A-D and Comparative Oils 1-3 were formulated to meet the specifications for SAE J300 revised November 2007 requirements for a 0W-20 multigrade engine oil.

Oil A: A 0W-20 viscosity grade fully formulated lubricating oil composition was prepared comprising 50 wt. % Group III Base oil (4.1 cSt at 100° C.), 20 wt. % Group IV PAO base oil (5.7 cSt at 100° C.), 10 wt. % Group V Ester base oil (3.2 cSt at 100° C.), about 8 wt. % of an ethylene carbonate treated bis-succinimide dispersant, 1.5 wt. % of a Mannich reaction product (a reaction product of polyisobutyl-substituted phenol (prepared with a 1,000 number average molecular weight polyisobutylene having greater than 70 wt. % methylvinylidene isomer), sodium glycine, and formaldehyde), and typical amounts of detergents, phosphorous antiwear agent, antioxidant, friction modifier, foam inhibitor, viscosity index improver, pour point depressant, and diluent oil. Oil A had a sulfated ash content of about 0.82 wt. %, sulfur content of about 0.18 wt. %, and a phosphorus content of about 0.074 wt. %.

Oil B: the formulation of Oil A was substantially duplicated except that Oil B had 50.50 wt. % of Group III Base oil (4.1 cSt at 100° C.). Oil B had a sulfated ash content of about 0.94 wt. %, sulfur content of about 0.20 wt. %, and a phosphorus content of about 0.07 wt. %. Oil B was a 0W-20 viscosity grade lubricating oil composition.

Oil C: the formulation of Oil A was substantially duplicated except that Oil C had 8.0 wt. % of a mixed dispersant system (borated bis-succinimide and ethylene carbonate post-treated bis-succinimide). Oil C had a sulfated ash content of about 0.92 wt. %, sulfur content of about 0.18 wt. %, and a phosphorus content of about 0.07 wt. %. Oil C was a 0W-20 viscosity grade lubricating oil composition.

Oil D: the formulation of Oil A was substantially duplicated except that Oil D had 52.10 wt. % Group III Base oil (4.1 cSt at 100° C.) and 3.0 wt. % of the Mannich reaction product. Oil D had a sulfated ash content of about 0.53 wt.

%, sulfur content of about 0.18 wt. %, and a phosphorus content of about 0.07 wt. %. Oil D was a 0W-20 viscosity grade lubricating oil composition.

Comparative Oil 1: the formulation of Oil A was substantially duplicated except that Comparative Oil 1 had 1.50 wt. % of the Mannich reaction product, 79.7% Group III Base oil (4.1 cSt at 100° C.), and no Group IV PAO base oil or Group V Ester base oil. Comparative Oil 1 had a sulfated ash content of about 0.82 wt. %, sulfur content of about 0.18 wt. %, and a phosphorus content of about 0.07 wt. %. Comparative Oil 1 was a 0W-20 viscosity grade lubricating oil composition.

Comparative Oil 2: the formulation of Oil A was substantially duplicated except that Comparative Oil 2 had 2.25 wt. % of the Mannich reaction product, 79.7% Group III Base oil (4.1 cSt at 100° C.), and no Group IV PAO base oil or Group V Ester base oil. Comparative Oil 2 had a sulfated ash content of about 0.79 wt. %, sulfur content of about 0.18 wt. %, and a phosphorus content of about 0.07 wt. %. Comparative Oil 2 was a 0W-20 viscosity grade lubricating oil composition.

Comparative Oil 3: the formulation of Oil A was substantially duplicated except that Comparative Oil 3 had 52.10 wt. % Group III Base oil (4.1 cSt at 100° C.). Comparative Oil 3 had a sulfated ash content of about 0.53 wt. %, sulfur content of about 0.18 wt. %, and a phosphorus content of about 0.07 wt. %. Comparative Oil 3 was a 0W-20 viscosity grade lubricating oil composition.

TABLE III

| Test type: VWTDI2: SAE: 0W-20 | | | | |
|---|---|---|---|---|
| Measurements | Oil A | Oil B | Oil C | Oil D |
| Inspection | 54 hours | 54 hours | 54 hours | 54 hours |
| PClnCandAvg | 70 | 67 | 68 | 70 |
| PClnRL206Avg | 65 | 65 | 65 | 65 |
| AvRS8R4P, ASF | 0 | 0 | 0 | 0 |
| #RngASF >=2.5 | 0 | 0 | 0 | 0 |
| ASFG1RSMAXme | 0 | 0 | 0 | 0 |
| ASFG2RSMAXme | 0 | 0 | 0 | 0 |
| Pass/Fail | Pass VW | Pass VW | Pass VW | Pass VW |

TABLE IV

| Test type: VWTDI2: SAE: 0W-20 | | | |
|---|---|---|---|
| Measurements | Comp. Oil 1 | Comp. Oil 2 | Comp Oil 3 |
| Inspection | 54 hours | 54 hours | 54 hours |
| PClnCandAvg | 63 | 61 | 64 |
| PClnRL206Avg | 65 | 65 | 65 |
| AvRS8R4P, ASF | 0 | 0.31 | 0 |
| #RngASF >=2.5 | 0 | 1 | 0 |
| ASFG1RSMAXme | 0 | 0.25 | 0 |
| ASFG2RSMAXme | 0 | 0 | 0 |
| Pass/Fail | Fail C3 | Fail C3 | Fail C3 |

The pass/fail score according to ACEA standards B4, B5, C3, and VW limits are listed in the following Table V. If the VW 504/507 limits are passed then the remaining specifications are also passed.

TABLE V

| | ACEA A3/B4 limits | ACEA A5/B5 limits | ACEA C3 limits | VW 504/507 limits |
|---|---|---|---|---|
| Piston Merit, Avg | ≥RL206 | (≥RL206) | (≥RL206) | (≥RL206 + std) |
| Ring sticking. | <=1.0 | <=1.0 | <=1.0 | <=1.0 |
| Avg. 1st gr, ASF, max. Ring sticking. | ≤1.0 | ≤1.0 | ≤1.0 | ≤1.0 |
| Max. 1st gr, ASF, max. Ring sticking. | ≤0.0 | ≤0.0 | ≤0.0 | ≤0.0 |
| Max. 2nd gr, ASF, max. | | | | |
| TBN at EOT | >=6.0 | >=4.0 | Report | |
| TAN at EOT | Report | Report | Report | |

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising:

(a) from about 50 to about 65 wt. %, based on the total weight of the lubricating oil composition, of a first base oil component having a kinematic viscosity (Kv) at 100° C. of about 3.5 to about 4.5 centistokes (cSt);

(b) from about 10 to about 30 wt. %, based on the total weight of the lubricating oil composition, of a second base oil component having a Kv at 100° C. of about 5.5 to about 6.5 cSt;

(c) about 1.5 wt. % to about 10 wt. %, based on the total weight of the lubricating oil composition, of at least one Mannich reaction product prepared by the condensation of a polyisobutyl-.substituted hydroxyaromatic compound, wherein the polyisobutyl group is derived from polyisobutene containing at least about 70 wt. % methylvinylidene isomer and has a number average molecular weight of from about 400 to about 2,500, an aldehyde, an amino acid or ester derivative thereof, and an alkali metal base; and (d) at least one ashless dispersant other than component (c);

wherein the lubricating oil composition has a sulfur content of less than or equal to about 0.30 wt. %, a phosphorus content of less than or equal to about 0.09 wt. %, and a sulfated ash content of less than or equal to about 1.60 wt. % as determined by ASTM D 874, based on the total weight of the lubricating oil composition; and further wherein the lubricating oil composition is a multigrade lubricating oil composition meeting the specifications for SAE J300 revised November 2007 requirements for a 0W-X multigrade engine oil, wherein X is 20, 30, 40, 50, or 60;

with the proviso that when the lubricating oil composition has a sulfated ash content of less than or equal to 0.60 wt.%, based on the total weight the lubricating oil composition, the Mannich reaction product is present in at least about 3.0 wt. %, based on the total weight of the lubricating oil composition.

2. The lubricating oil composition of claim 1, which is a SAE 0W-20 multi-grade lubricating oil composition or a 0W-30 multi-grade lubricating oil composition.

3. The lubricating oil composition of claim 1, having a sulfur content of from about 0.01 wt. % to about 0.30 wt. %, a phosphorus content of from about 0.01 wt. % to about 0.07 wt. %, and a sulfated ash content of from about 0.10 wt. % to about 0.8 wt. % as determined by ASTM D 874, based on the total weight of the lubricating oil composition.

4. The lubricating oil composition of claim 1, wherein the first base oil component is a Group III base oil and the second base oil component is a Group IV polyalphaolefin base oil.

5. The lubricating oil composition of claim 1, wherein the lubricating oil composition further comprises an ester base oil.

6. The lubricating oil composition of claim 5, wherein the ester base oil is present in the lubricating oil composition in an amount of from about 1 to about 10 wt. %, based on the total weight of the lubricating oil composition.

7. The lubricating oil composition of claim 1, wherein the polyisobutyl group of the polyisobutyl-substituted hydroxyaroinatic compound is derived from polyisobut containing at least about 90 wt. % methylvinylidene isomer.

8. The lubricating oil composition of claim 1, wherein, the polyisobutyl group of the polyisobutyl-substituted hydroxyaromatic compound has a number average molecular weight in the range of from about 500 to about 2,500.

9. The lubricating oil composition of claim 1, wherein the wherein the aldehyde is formaldehyde or paraformaldehyde, the base is an alkali metal hydroxide and the amino acid is glycine.

10. The lubricating oil composition of claim 1, wherein the at least one Mannich reaction product is of the formula

I

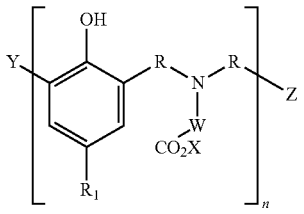

wherein each R is independently —CHR'—, wherein R' is branched or linear alkyl having one to about 10 carbon atoms, cycloalkyl having from about 3 carbon atoms to about 10 carbon atoms, aryl having from about 6 carbon atoms to about 10 carbon atoms, alkaryl having from about 7 carbon atoms to about 20 carbon atoms, or aralkyl having from about 7 carbon atoms to about 20 carbon atoms, $R_1$ is a polyisobutyl group derived from polyisobutene containing at least about 70 wt. % tnethylvinylidene isomer and having a number average molecular weight in the range of about 400 to about 2,500;

X is hydrogen, an alkali metal ion, or alkyl having one carbon atom to about 6 carbon atoms;

W is —[CHR"]—$_m$ wherein each R" is independently H, alkyl having one carbon atom to about 15 carbon atoms, or a substituted-alkyl having one carbon atom to about 10 carbon atoms and one or more substituents selected from the group consisting of amino, amido, benzyl, carboxyl, hydroxyl, hydroxyphenyl, imidazolyl, irnino, phenyl, sulfide, or thiol; and m is an integer from one to 4;

Y is hydrogen, alkyl having one carbon atom to about 10 carbon atoms, —CHR'OH, wherein R' is as defined above, or

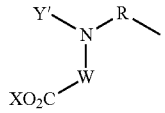

wherein Y' is —CHR'OH, wherein R' is as defined above; and R, X, and W are as defined above;

Z is hydroxyl, a hydroxyphenyl group of the formula

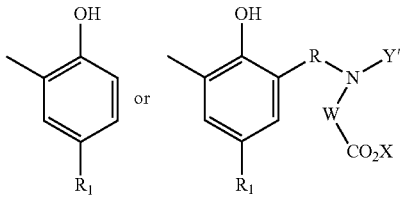

wherein R, $R_1$, Y', X, and W are as defined above, and n is an integer from 0 to 20, with the proviso that when n=0, Z must be:

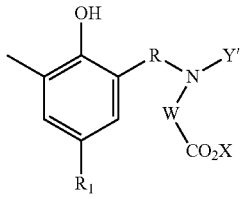

wherein R, $R_1$, Y', X, and W are as defined above.

11. The lubricating oil composition of claim 1, wherein the at least one ashless dispersant is selected from the group consisting of a polyalkylene succinic anhydride ashless dispersant, a non-nitrogen containing ashless dispersant and a basic nitrogen-containing ashless dispersant.

12. The lubricating oil composition of claim 1, wherein the at least one ashless dispersant is present in an amount ranging from about 0.1 wt. % to about 10 wt. %, based on the total weight of the lubricating oil composition.

13. The lubricating oil composition of claim 1, further comprising one or more lubricating oil additives selected from the group consisting of an antioxidant, detergent, rust inhibitor, dehazing agent, dermilsifying agent, metal deactivating agent, friction modifier, antiwear agent, pour point depressant, antifoaming agent, co-solvent, package compatibiliser, corrosion-inhibitor, dye, extreme pressure agent and mixtures thereof.

14. The lubricating oil composition of claim 1, which is a heavy duty diesel engine lubricating oil composition.

15. A method for improving the piston cleanliness of an internal combustion engine, the method comprising operating the internal combustion engine with a lubricating oil composition comprising:

(a) from about 50 to about 65 wt. %, based on the total weight of the lubricating oil composition, of a first base oil component having a Kv at 100° C. of about 3.5 to about 4,5 cSt;

(b) from about 10 to about 30 wt. %, based on the total weight of the lubricating oil composition, of a second base oil component having a Kv at 100° C. of about 5.5 to about 6,5 cSt;

(c) about 1.5 wt. % to about 10 wt. %, based on the total weight of the lubricating oil composition, of at least one Mannich reaction product prepared by the condensation of a polyisobutyl-substituted hydroxyaromatic compound, wherein the polyisobutyl group is derived from polyisobutene containing at least about 70 wt. % methylvinylidene isomer and has a number average molecular weight of from about 400 to about 2,500, an aldehyde, an amino acid or ester derivative thereof, and an alkali metal base; and (d) at least one ashless dispersant other than component (c);

wherein the lubricating oil composition has a sulfur content of less than or equal to about 0.30 wt. %, a phosphorus content of less than or equal to about 0.09 wt. %, and a sulfated ash content of less than or equal to about 1.60 wt. % as determined by ASTM D 874, based on the total weight of the lubricating oil composition; and further wherein the lubricating oil composition is a multigrade lubricating oil composition meeting the specifications for SAE J300 revised November 2007 requirements for a 0W-X multigrade engine oil, wherein X is 20, 30, 40, 50, or 60;

with the proviso that when the lubricating oil composition has a sulfated ash content of less than or equal to 0.60 wt. %, based on the total weight the lubricating oil composition, the Mannich reaction product s present in at least about 3.0 wt. %, based on the total weight of the lubricating oil composition.

16. The method of claim 15, wherein the first base oil component is a Group III base oil and the second base oil component is a Group IV polyalphaolefin base oil.

17. The method of claim 15, wherein the wherein the at least one Mannich reaction product is of the formula

I

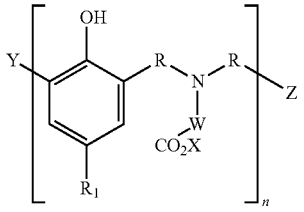

wherein each R is independently —CHR'—, wherein R' is branched or linear alkyl having one to about 10 carbon atoms, cycloalkyl having from about 3 carbon atoms to about 10 carbon atoms, aryl having from about 6 carbon atoms to about 10 carbon atoms, alkaryl having from about 7 carbon atoms to about 20 carbon atoms, or aralkyl having from about 7 carbon atoms to about 20 carbon atoms, $R_1$ is a polyisobutyl group derived from polyisobutene containing at least about 70 wt. % methylvinylidene isomer and having a number average molecular weight in the range of about 400 to about 2,500;

X is hydrogen, an alkali metal ion, or alkyl having one carbon atom to about 6 carbon atoms;

W is —[CHR"]—$_m$ wherein each R" is independently H, alkyl having one carbon atom to about 15 carbon atoms, or a substituted-alkyl having one carbon atom to about 10 carbon atoms and one or more substituents selected from the group consisting of amino, amido, benzyl, carboxyl, hydroxyl, hydroxyphenyl, imidazolyl, imino, phenyl, sulfide, or thiol; and m is an integer from one to 4;

Y is hydrogen, alkyl having one carbon atom to about 10 carbon atoms, —CHR'OH, wherein R' is as defined above, or

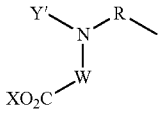

wherein Y' is —CHR'OH, wherein R" is as defined above; and R, X, and W are as defined above;

Z is hydroxyl, a hydroxyphenyl group of the formula

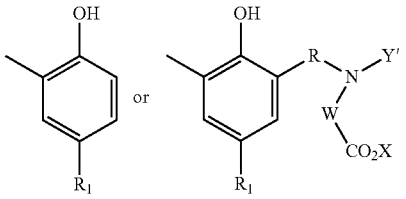

wherein R, $R_1$, Y', X, and W are as defined above, and n is an integer from 0 to 20, with the proviso that when n=0, Z must be:

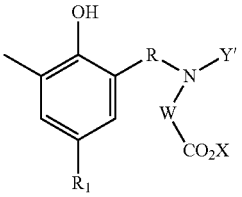

wherein R, $R_1$, Y', X, and W are as defined above.

18. The method of claim 15, wherein the at least one ashless dispersant is selected from the group consisting of a polyalkylene succinic anhydride ashless dispersant, non-nitrogen containing ashless dispersant and basic nitrogen-containing ashless dispersant.

19. The method of claim 15, wherein the at least one ashless dispersant is present in the lubricating oil composition in an amount ranging from about 0.1 wt. % to about 10 wt. %, based on the total weight of the lubricating oil composition.

20. The method of claim 15, wherein the lubricating oil composition further comprises one or more lubricating oil additives selected from the group consisting of an antioxidant, detergent, rust inhibitor, dehazing agent, demulsifying agent, metal deactivating agent, friction modifier, antiwear agent, pour point depressant, antifoaming agent, co-solvent, package compatibiliser, corrosion-inhibitor, dye, extreme pressure agent and mixtures thereof.

21. The method of claim 15, wherein the internal combustion engine is a heavy duty diesel engine.

* * * * *